United States Patent [19]

Jacobson

[11] 4,183,447

[45] Jan. 15, 1980

[54] DRAPERY PIN PACKAGING AND DISPENSING DEVICE

[76] Inventor: Abraham Jacobson, 7900 Garner St., Long Beach, Calif. 90808

[21] Appl. No.: 909,825

[22] Filed: May 26, 1978

[51] Int. Cl.[2] ..... B65G 59/08

[52] U.S. Cl. ..... 221/232

[58] Field of Search ..... 221/227, 232, 276, 279, 221/312

[56] References Cited

U.S. PATENT DOCUMENTS

| | | | |
|---|---|---|---|
| 2,888,680 | 6/1959 | Krivis | 221/232 X |
| 3,422,989 | 1/1969 | Long, Jr. | 221/232 X |

*Primary Examiner*—Stanley H. Tollberg

*Attorney, Agent, or Firm*—Poms, Smith, Lande & Rose

[57] ABSTRACT

A device for dispensing drapery pins including a casing for accommodating a stack of pins in side-by-side relationship and an elongated shroud having a pin receiver for accommodating a single pin pivotally connected at one end to the casing with its free end having a guide plate cooperating with a slot in the casing for maintaining the receiver in proper alignment. The pins are mounted on a rack removably inserted in the housing with a spring-biased plunger urging the leading pin of the stack onto the receiver. Pressing down of the shroud moves the point of the pin on the receiver out of the casing for ready insertion into a drapery.

10 Claims, 9 Drawing Figures

DRAPERY PIN PACKAGING AND DISPENSING DEVICE

BACKGROUND OF THE INVENTION

1. Field of the Invention

The invention relates to devices for facilitating the insertion of drapery pins into drapery materials.

2. Description of the Prior Art

Drapery pins currently in vogue are of a unitary construction and generally of S-shaped configuration. One end of the pin is pointed and enters the fabric material. The U-bend formed adjacent this end provides a seat for the fabric. The other end of the pin is inserted through an eyelet or the like provided by a drapery rod, and the adjacent U-bend rests in the eye, whereby the drapery is appropriately suspended.

In practice, loose pins are picked up one by one and appropriately oriented and located relative to the edge of the drapery for insertion. Substantial time is wasted in manipulating the pins preparatory for insertion into the fabric. Manipulation of these pins, not altogether simple, is quite fatiguing. Considerable force is often required on the part of the drapery worker in order to insert the pin properly while grasping the pin between his fingers, especially in connection with heavy drapery materials. For this reason and for the reason that a large number of separate pins are handled, heavy callouses are developed on the fingers of drapery workers.

Various automatic tools, such as those described and claimed in U.S. Pat. Nos. 3,570,710 and 2,888,680, have been suggested that, when loaded, expedite the entire operation and obviate separate, or any, handling of the pins proper. For this purpose, these tools serve to contain a supply of pins, and have means for partial ejection of the end pin so that it may be inserted in the drapery material prior to the time it leaves the tool. The seating force is applied through the tool, which is easily grasped, to the pin. The succeeding pin is automatically available for the next operation of the tool. In this manner, actual handling of the pin is obviated.

However, such tools have not always worked properly and efficiently and are difficult to load. For example, any deviation from the angle of entry of the pin into the drapery material, due to construction of the tool, results in the pin not properly seating. There is a need for such tool which is steady in operation and always inserts the pin into the drapery material at the correct angle for proper alignment.

SUMMARY OF THE INVENTION

It is an object of this invention to provide a device for facilitating insertion of drapery pins into drapery material which is easier to load than prior art devices.

It is a further object of this invention to provide such a device which works efficiently without jamming and releases hooks therefrom in correct alignment with the drapery material.

It is still another object of this invention to provide such a device ejects a hook therefrom at an improved angle to the drapery material.

It is still further an object of this invention to provide such device which is sturdy but less bulky than prior art devices and provides a more positive grip to the user thereof over prior art devices.

These and other objects are preferably accomplished by providing a casing for accommodating a stack of pins in side-by-side relationship and an elongated shroud having a pin receiver for accommodating a single pin pivotally connected at one end to the casing with its free end having a guide plate cooperating with a slot in the casing for maintaining the receiver in proper alignment. The pins are mounted on a rack removably inserted in the housing with a spring biased plunger urging the leading pin of the stack onto the receiver. Pressing down of the shroud moves the point of the pin on the receiver out of the casing for ready insertion into a drapery.

DESCRIPTION OF THE PREFERRED EMBODIMENT

Figures 1, 6, 8, 9, 10:
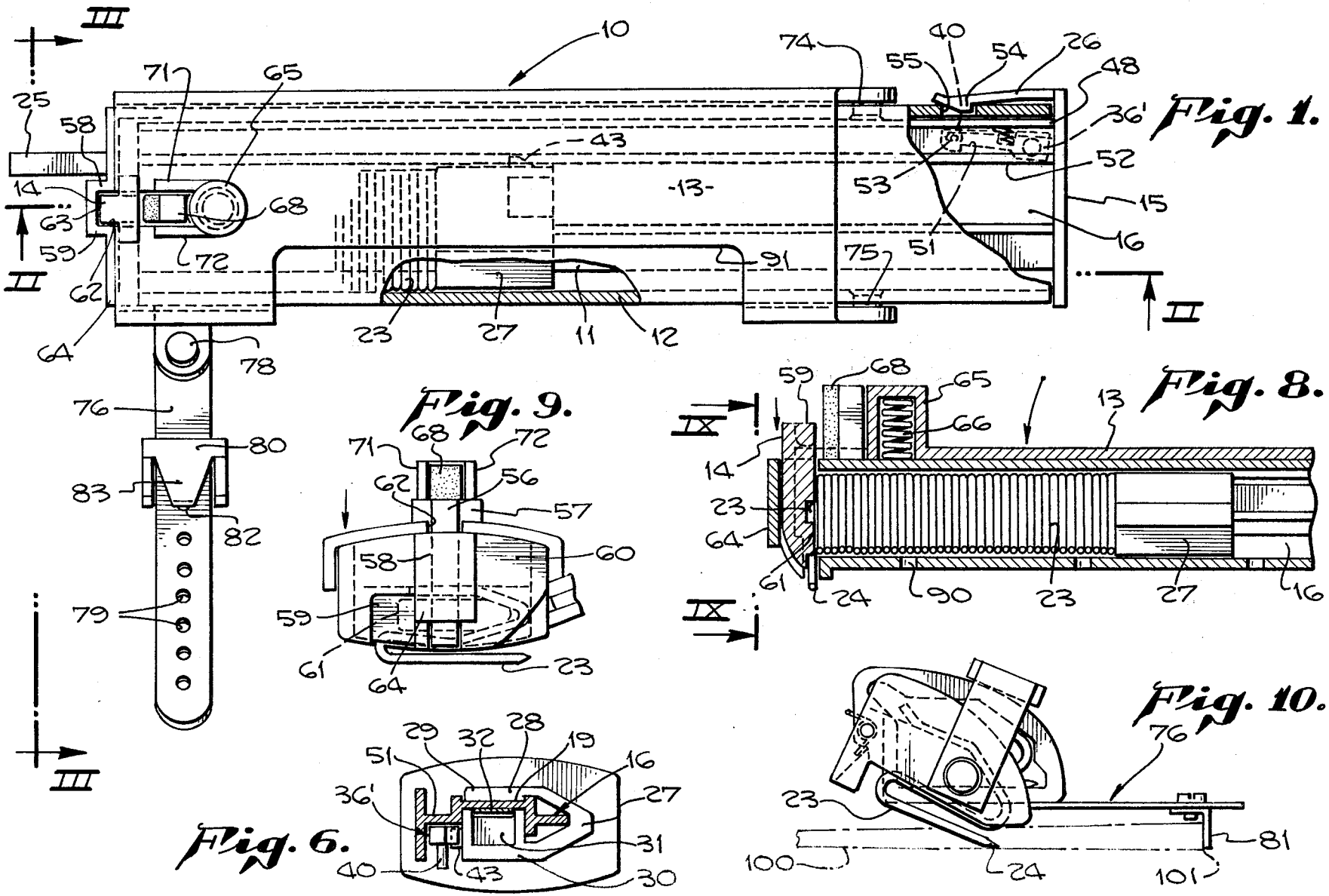
FIG. 1 is a top plan view, partly in cross-section, of a drapery pin packaging and dispensing device in accordance with the teachings of my invention.
FIG. 6 is a view taken along lines VI—VI of FIG. 5.
FIG. 8 is a cross-sectional view of a portion of the device of FIG. 1 showing pins installed therein.
FIG. 9 is an end view of the device of FIG. 7 taken along lines IX—IX thereof.

Referring now to FIG. 1 of the drawing, the drapery pin packaging and dispensing device 10 includes a pin storage means 11, a pin storage receiving means 12, a movable shroud 13 on the storage receiving means 12 and a pin ejecting means 14 adapted to be inserted into the pin storage receiving means 12.

Figure 4:
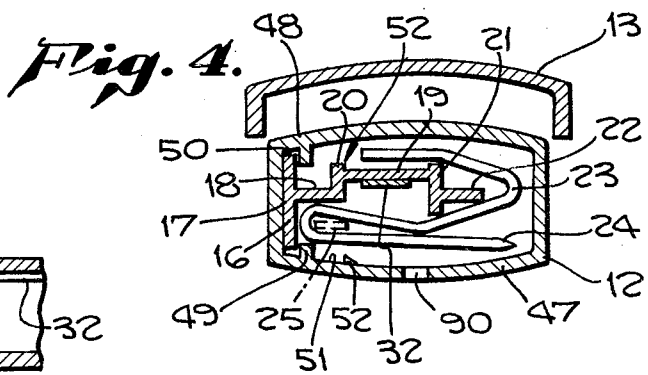
FIG. 4 is a cross-sectional view taken along lines IV—IV of FIG. 2.

As shown in FIG. 1, pin storage means 11 includes a stop plate 15 integral with an elongated rack 16. As can be seen in FIG. 4, rack 16, a cross-section, shows an end rib 17, a first generally flat member 18 extending normal to rib 17, a channel member 19 extending from member 18, a pair of side members 20, 21 forming sidewalls of channel member 19 and an outer rib 22 extending normal from side member 21.

In my U.S. Pat. No. 2,939,147, I disclose a drapery hook clip for storing a plurality of drapery pins. One such pin 23 is shown in FIG. 4 having a pointed fabric penetrating point 24. Pin 23 is configured so as to be insertable on rack 16 as shown in FIG. 4 with a spline 25, similar to spline 11 in my aforementioned U.S. Pat. No. 2,939,147, insertable in pins 23. It is to be understood that pin 23 in FIG. 4 is the end pin of a plurality of like pins and may take various configurations. In my U.S. Pat. No. 2,939,147, in FIG. 1 thereof, I show a plurality of pins insertable on a rack 7 with a removable spline 11. The teachings thereof are hereby incorporated herein by reference.

Figure 7:
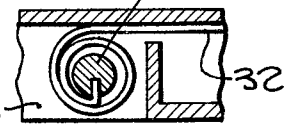
FIG. 7 is a cross-sectional view taken along the lines VII—VII of FIG. 5.
Figure 5:
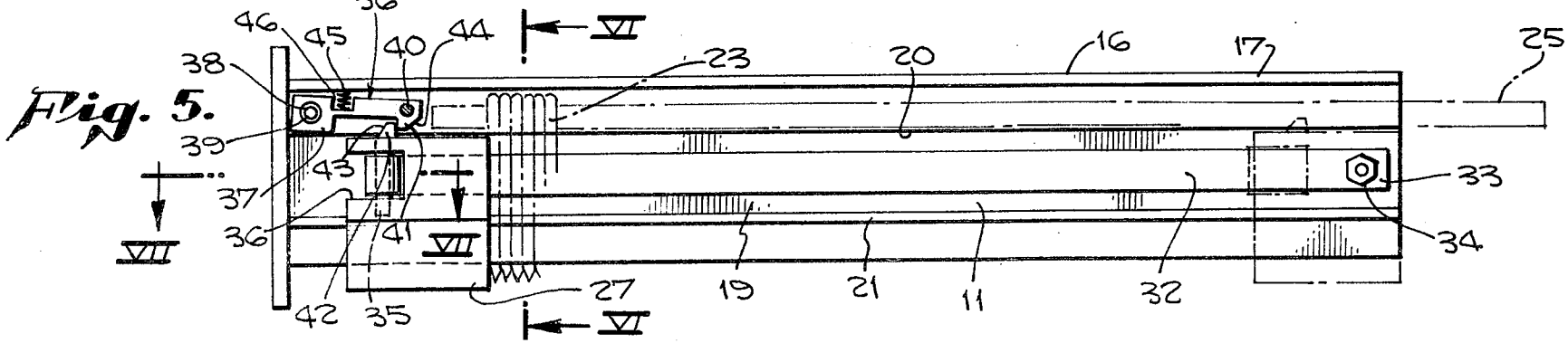
FIG. 5 is a vertical view of one of the components of the device of FIG. 1.

Referring again to FIG. 1, pin storage means 11 includes a plunger release member 26, the operation of which will be more fully explained hereinbelow, and a plunger 27 (FIG. 5). As shown in FIG. 6, plunger 27 includes a first portion 28 having a flat plate 29 adapted to ride along the underside of channel member 19, a second portion 30 having a block member 31 adapted to ride along channel member 19 and a spring 32 having one end 33 (FIG. 5) secured to rack 16 by a nut and bolt 34 which nut and bolt 34 also acts as a stop for plunger 27. As can be seen in FIGS. 5 and 7, the other end of spring 32 is fixedly secured to a cross-pin 35 (FIG. 2) in a cut-out portion 36 of plunger 27. As will be discussed, movement of plunger 27 to the FIG. 5 position from a position adjacent end 33, extends the elongated spring 32 so that, when released from the FIG. 5 position, spring 32 retracts plunger 27 back to the position adjacent end 33, the nut and bolt 34 preventing movement of plunger 27 off of rack 16.

As particularly contemplated in the present invention, plunger retaining means 36' is provided on rack 16 for retaining plunger 27 in the FIG. 5 position. Such means 36', FIG. 5, includes a flange member 37 pivotally mounted to rack 16 via a pin 38 fixedly mounted in rack 16 retained on pin 38 by a lock washer 39. A release pin 40 extends outwardly from flange member 37 and a lip 41 is provided on the underside of flange member 37. An abutment member 42 is provided on the upper surface of plunger 27. When plunger 27 is manually moved from a position adjacent end 33 of spring 32 to the FIG. 5 position, the tapered portion 43 of abutment member 42 moves against the tapered portion 44 of lip 41. A spring 45 is trapped against the inner wall of rib 17 and a cavity 46 in flange member 37 to normally bias flange member 37 to the FIG. 5 position. When tapered portion 43 contacts tapered portion 44, it moves flange member 37 against the bias of spring 45 until tapered portion 43 passes tapered portion 44 and abutment member 42 engages lip 41 as seen in FIG. 5. The pins 23 are now loaded onto rack 16, as discussed hereinabove with respect to FIG. 4 and in my U.S. Pat. No. 2,939,147, with spline 25 extending through pins 23 and out of rack 16 and in a position to be grasped by an operator to release pins 23, as will be discussed.

Referring again to FIG. 4, storage receiving means 12 includes a tube 47 having a pair of elongated upper and lower flanges 48, 49 forming a slot or channel 50. With means 11 loaded with pins 23, means 11 is insertable in the open end of tube 47 (FIG. 4) with rib 17 entering channel 50 and flange member 37 riding in a channel 51 formed between flange 49 and flange 52. As can be seen in FIG. 1, channel 51 does not extend all the way along tube 47 and curves inwardly at curved portion 53 to flange 48. Thus, as means 11 is pushed through tube 47, when release pin 40 of flange member 37 hits the curved portion 53, it moves flange member 37 against the bias of spring 45 (and thus member 42 out of engagement with member 41) to thereby release plunger 27 which moves against the rearmost ones of pins 23 to push pins 23 toward the pin releasing end of device 10, as will be discussed.

Stop plate 15 abuts against and closes off the open end of tube 47 and member 26 includes a lock tab 54 which enters an opening 55 in tube 47 (FIG. 1) to prevent removable of rack 16 until tab 54 is released. The final assembled device is shown in FIG. 1. The spline 25 extends out of the device 10 and can be pulled out of engagement with pins 23.

Figure 2:
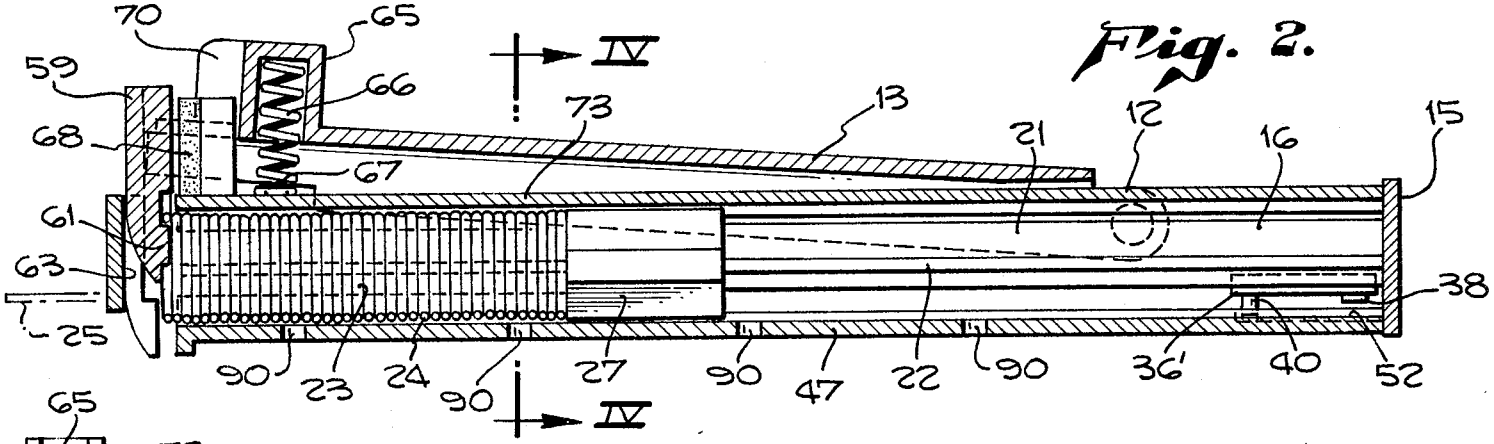
FIG. 2 is a cross-sectional view of the device of FIG. 1 taken along lines II—II thereof.

An end plate 56 (FIGS. 3 and 9) is provided at the forward end of device 10. As seen in FIG. 9, end plate 56 includes a lock pin 57 at the upper end thereof which fits into a cut-out portion 62 on tube 47 (see also FIG. 1) and a pair of integral downwardly extending ribs 58, 59 formed on a flat plate 60. Inwardly of flat plate 60, as seen in FIG. 2, is an integral boss 61 similar to the boss 19 described in U.S. Pat. No. 2,888,680. This boss 19 is configured to support pins 23 as described in U.S. Pat. No. 2,888,680, the teachings of which are incorporated herein by reference. As can be seen in FIG. 1, ribs 58, 59 ride in a cavity 63 formed in the front wall 64 of tube 47. A spring housing 65 (see also FIG. 8) is provided on the upper surface 69 of shroud 13 receiving therein a coil spring 66 which has one end in housing 65 and the other end surrounding a boss 67 on the upper surface 73 of tube 47 (see FIG. 2). A guide member 68 extends upwardly from the surface 73 (FIG. 2) and rides in a slot 70 formed by the side frames 71, 72 (FIG. 3) on housing 65. This maintains shroud 13 in alignment with tube 47.

Figure 3:
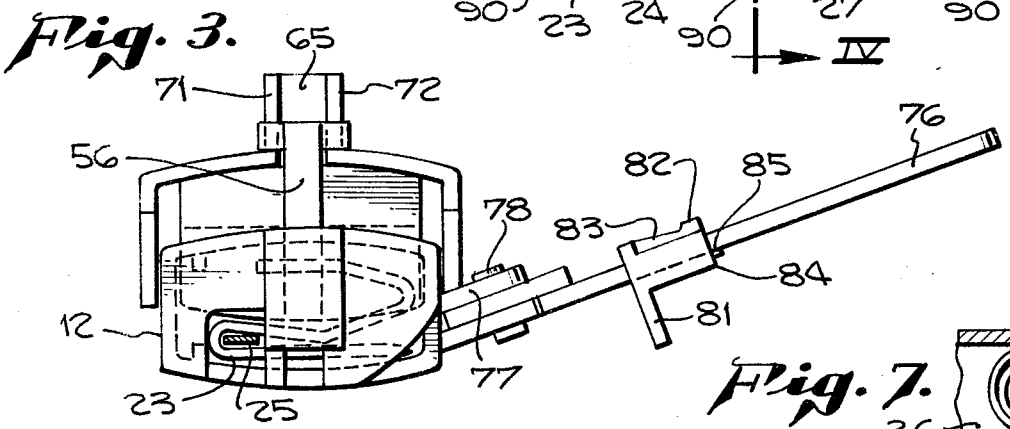
FIG. 3 is an end view of the device of FIG. 1 taken along lines III—III thereof.

Shroud 13 is pivotally connected to tube 47 at pivot points 74, 75 (FIG. 1). A gauge bar 76 is secured to a pair of ears 77 (see also FIG. 3) integral with tube 47 via a nut 78. A plurality of index holes 79 (FIG. 1) are provided along bar 76 and suitable indicia may be associated with each hole. As can be seen in FIG. 3, bar 76 is angled in a direction upwardly with respect to a horizontal plane passing through tube 47, as for example, an angle of about 30°. This reduces the chances of slippage since it locates the point of the pin for insertion at a better angle. A resilient slide member 80, having an arm 81 and a lock tab 82 (see also FIG. 1), is provided on bar 76. Lock tab 82 includes an upper member 83 and a lower member 84, which lower member 84 may have a nub 85 adapted to enter holes 79 thereon. Since all of the components of slide member 80 may be resilient, such as plastic, members 83, 84 grasp bar 76 with nub 85 entering one of the holes 79. In this manner, arm 81 may be moved to any desired location along slide 76 with members 83, 84 enabling arm 81 to be locked thereat but easily and quickly movable to another hole by releasing nub 85.

If desired, holes 90 (FIG. 2) may be placed at strategic locations along the underside of tube 47 to visually indicate the location of pins 23 and thus determine how full the device is. Shroud 13 may be cut-out, as at cut-out 91, to make it less bulky whereas its curved configuration (FIG. 9, for example), gives it rigidity.

Operation

In operation, plunger 27 is manually moved to the FIG. 5 position against the bias of spring 32 with means 36' retaining plunger 27 in the FIG. 5 position as heretofore described. Pins 23, which have been previously mounted on spline 25, are inserted on rack 16, as shown in FIG. 4, with spline 35 extending out of rack 16, as shown in FIG. 5. The assembled rack 16 is then inserted into tube 47 as shown in FIG. 4 and heretofore described. The final assembled position is shown in FIG. 1. It can be seen that lock tab 54 enters opening 55 to retain the rack 16 in position in tube 47. Plunger 27 is released when pin 40 engages wall 53 of slot 51 which forces pins 23 toward the discharge end of device 10 (to the right in FIG. 1). Spline 25 is in position to be pulled out of assembly 10 and thus release pins 23.

Slide member 80 is then moved along bar 76 by grasping arm 81 with lock tab 82 entering one of the preselected holes 79. As shown in FIG. 3, arm 81 is adapted to abut against the edge of a drapery. The angular orientation of arm 76 provides a proper angle for the point 24 of pin 23 to enter the drapery as described in detail in U.S. Pat. No. 2,888,680.

The operator grasps the tube 47 in the palm of his hand with his thumb on the top of shroud 13. By pressing down on shroud 13, the shroud 13 pivots about points 74, 75 moving end plate 56 downwardly. The boss 61 on plate 56 receives the leading pin 23 thereon as shown in FIG. 2, which pin 23 is biased by plunger 27. Pressing on shroud 13 thus carries pin 23 to a position wherein the point 24 of pin 23 can be inserted into the drapery at the proper angle. Release of shroud 13 restores it to the FIG. 2 position by means of the spring bias of spring 66. A subsequent pin 23 is moved to the boss 61 in position for release therefrom.

It can be seen that I have disclosed a device which releases drapery pins one-at-a time for insertion at a desired angle into a drapery. By having plate 56 separate from shroud 13 and guided as heretofore disclosed, better control is obtained. In other words, the device 10 works efficiently even if there is lateral play between the shroud 13 and tube 47.

By having the plunger 27 locked in position, easier pin loading is possible, the engagement of the pin 40 with the slot 51 releasing the plunger 27 automatically thereby biasing the pins 23 toward plate 56.

The device 10 of my invention also provides an adjustable measuring device, i.e. the gauge bar 76, to insert the pins 23 at the same distance from the top of the drape each time a pin 23 is inserted.

I claim:

1. In a device for dispensing drapery pins including a casing for accommodating a stack of pins in side-by-side relationship, a cover member having pin receiving means thereon for accommodating a single pin, said cover member having pin urging means thereon for urging the single pin away from said stack, the improvement which comprises:

said cover member is an elongated shroud pivotally mounted at one end to said casing, said pin receiving means including a flange plate fixedly secured to said shroud having an outer configuration substantially the same as the inner configuration of said pins for receiving a leading one of said pins thereon, said flange plate being guided in movement in a direction normal to the longitudinal axis of said shroud when said shroud is pivoted on said casing, said pin urging means including a rack having said stack mounted thereon and a spring biased plunger on said rack abutting against the terminal end of said stack to thereby urge said pins toward said flange plate whereby pivotal movement of said shroud urges the point of said pin carried by said flange plate out of said device for insertion into a drapery.

2. In the device of claim 1 wherein said shroud is spring-biased in a direction away from said casing.

3. In the device of claim 1 wherein said casing includes a front wall with a slot formed therein and said shroud includes a guide plate having a boss thereon movable in said slot in said front wall, said flange plate being fixedly secured to the side of said guide plate opposite the side having said boss thereon.

4. In the device of claim 1 wherein said casing includes an elongated guide arm extending upwardly and away from said casing at an angle thereto, said arm having a plurality of spaced apertures therein, and a slidably mounted indexing member on said arm having a tang thereon adapted to snap fit into said apertures and a downwardly extending guide flange.

5. In the device of claim 1 wherein said rack includes guide flanges thereon adapted to cooperate with internal guide flanges on said casing for insertion of said rack in said casing in a predetermined orientation.

6. In the device of claim 1 wherein said rack includes plunger locking means thereon for locking said plunger in a retracted position on said rack prior to insertion of said stack of pins thereon, said casing including plunger locking release means for releasing automatically said plunger into biasing engagement with said stack of pins when said rack is inserted into said casing.

7. In the device of claim 6 wherein said plunger locking means includes an abutment member on said plunger and a spring biased tang pivotally mounted on said rack, said tang engaging said abutment member to retain said plunger in a retracted position.

8. In the device of claim 7 wherein said plunger locking release means includes a pin on said tang and a slot formed in the inner wall of said casing adjacent the end thereof opposite said flange plate, engagement of said pin with said slot releasing said tang from engagement with said abutment member.

9. In the device of claim 1 wherein said plunger is biased by an elongated leaf spring having one end fixed to said rack and the other end fixed to said plunger.

10. In the device of claim 9 wherein said end fixed to said plunger includes a cut-out portion in said plunger and a pin having said leaf spring secured thereto fixedly mounted in said cut-out portion, said pin having its longitudinal axis transverse to the longitudinal axis of said leaf spring.

* * * * *